United States Patent [19]

Moriyama

[11] Patent Number: 4,966,558

[45] Date of Patent: Oct. 30, 1990

[54] COUPLER TERMINAL UNIT FOR SPEAKER

[75] Inventor: Yutaka Moriyama, Tendo, Japan

[73] Assignee: Pioneer Electronic Corporation, Tokyo, Japan

[21] Appl. No.: 352,520

[22] Filed: May 16, 1989

[30] Foreign Application Priority Data

Sep. 24, 1988 [JP] Japan ..... 63-240426

[51] Int. Cl.[5] ..... H01R 9/20; H01R 9/24

[52] U.S. Cl. ..... 439/573; 381/87; 439/709

[58] Field of Search ..... 439/573, 705, 712, 736; 381/87, 88, 124, 188, 205

[56] References Cited

U.S. PATENT DOCUMENTS 1,712,212 5/1929 Hardy ..... 439/573
4,829,582 5/1989 Heuvinck ..... 381/124 X

FOREIGN PATENT DOCUMENTS 2464613 4/1981 France ..... 381/87
0084991 4/1986 Japan ..... 381/87

*Primary Examiner*—Eugene F. Desmond
*Attorney, Agent, or Firm*—Sughrue, Mion, Zinn, Macpeak & Seas

[57] ABSTRACT

A coupler terminal unit for a speaker unit. The coupler terminal unit is connected to an attachment piece of a speaker frame by means of an eyelet. The coupler unit includes a housing portion and terminal pieces connected thereto. The eyelet is positioned at the housing portion.

4 Claims, 1 Drawing Sheet

COUPLER TERMINAL UNIT FOR SPEAKER

BACKGROUND OF THE INVENTION

The present invention relates to a coupler terminal unit for a speaker unit, and more particularly, to a type thereof which requires only a minimized attachment space.

A speaker unit is generally provided with a coupler terminal unit for receiving therein an input sound reproduction signal. One conventional coupler terminal unit is shown in FIGS. 1 and 2. The conventional coupler terminal unit C is fixedly connected to a tongue or attachment piece 3 formed with a hole 3*a*. The attachment piece 3 extends from an outer peripheral edge portion of a speaker frame 2 provided with a magnetic circuit. In other words, the attachment piece 3 extends outwardly in radial direction of the speaker frame 2. The terminal unit C includes a flat plate portion C1 formed with a hole 10 and a rectangular housing portion C2 integral with the flat plate portion C1. The flat plate portion C1 is secured with a terminal piece 6 formed with upstanding cut pieces 6X and notches 6Y for connecting lead lines or litz wires (not shown). The housing portion C2 includes upstanding wall 4 defining an internal space, and input terminals 4A are provided within the space.

The coupler terminal unit C is connected to the tongue piece 3 of the speaker frame 2 at the flat plate portion C1 by means of an eylet 5. The eylet 5 extends through the holes 10 and 3*a* and then pressure is applied to the ends of the eylet for its deformation. Therefore, the eylet 5 is positioned between the speaker frame 2 and the housing portion C2. Since the housing portion C2 is largely protruded, the housing portion C2 may become an obstacle in order to connect the tongue piece 3 to the flat plate portion C1. That is, the eylet 5 cannot be easily inserted into the holes 10 and 3*a*, and it would be rather difficult to apply pressure to the eylet 5 for its deformation due to such spacial problem.

Further, in case of a speaker unit for its installation in a vehicle compartment, only a limited space is provided for the attachment work. Furthermore, installation of the speaker unit to the vehicle compartment may also be troublesome due to various protruding components of the vehicle. In this connection, according to the conventional arrangement, since the coupler terminal unit C largely extends from the outer peripheral edge portion of the speaker frame in a radial direction by a length L, the unit C may apt to be abutted on a neighbouring vehicle component. Accordingly, installing posture of the speaker unit may be obliged to be modified.

Moreover, if the coupler housing C2 is in direct contact with the vehicle component, vibration of the vehicle may be transmitted to the speaker unit through the coupler terminal unit C. As a result, vibratory noise is directly transmitted to the speaker unit, to thereby modulate reproducing sound.

SUMMARY OF THE INVENTION

It is therefore, an object of the present invention to overcome the above-described drawbacks and to provide an improved coupler terminal unit for a speaker unit.

Another object of the invention is to provide such improved couper terminal unit capable of facilitating installation of a speaker unit to a vehicle compartment without any abutment of the coupler unit with the vehicle component, to thereby provide an optimum posture of the speaker unit relative to the vehicle compartment.

Still another object of the invention is to provide such couple terminal unit which has compact size, to thereby minimize a likelihood of abutting a neighbouring component of a vehicle, to thus avoid sound modulation.

These and other objects of the invention will be attained by providing a coupler terminal unit for a speaker unit which includes a speaker frame and an attachment piece extending radially outwardly from the speaker frame, the coupler terminal unit comprising: a housing portion having upstanding side walls and a bottom wall for defining an internal space; an eyelet member positioned at the internal space for fixely connecting the housing portion to the attachment piece; and a pair of terminal pieces each extending from each of the side walls of the housing portion.

DETAILED DESCRIPTION OF THE PREFERRED EMBODIMENT

Figure 1:
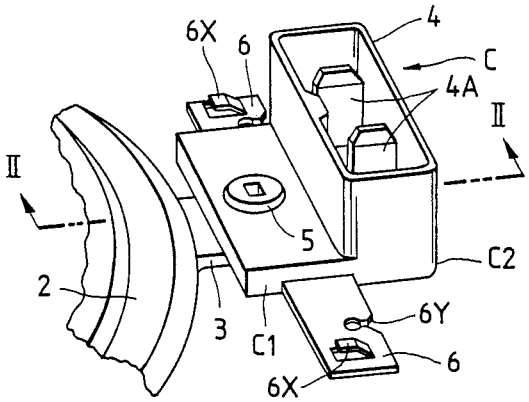
FIG. 1 PRIOR ART
FIG. 1 is a perspective view showing a conventional coupler terminal unit for a speaker unit.
Figure 2:
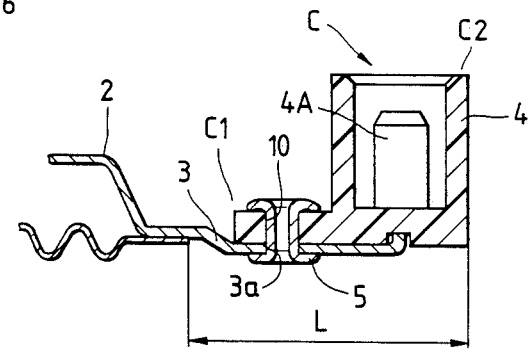
FIG. 2 PRIOR ART
FIG. 2 is a cross-sectional view taken along a line II—II of FIG. 1.
Figure 3:
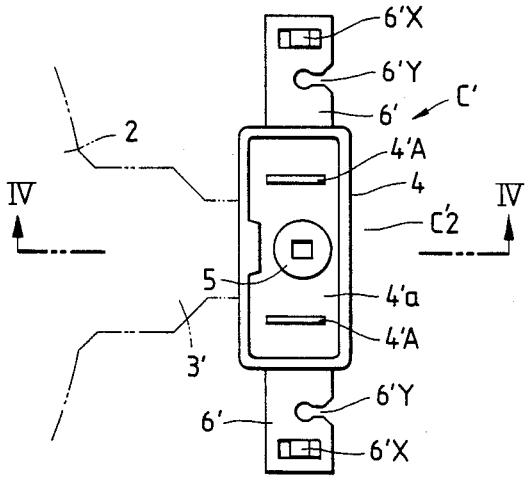
FIG. 3 is a plan view showing a coupler terminal unit according to the present invention.
Figure 4:
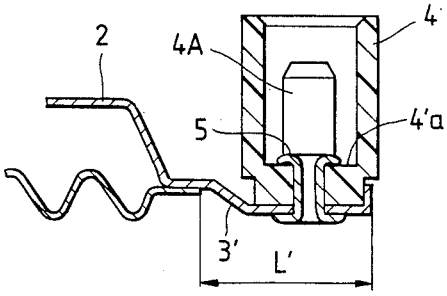
FIG. 4 is a cross-sectional view taken along a line IV—IV of FIG. 3.

A coupler terminal unit according to one embodiment of this invention will be described with reference to FIGS. 3 and 4 wherein like parts and components are designated by the same reference numerals and characters as those shown in FIGS. 1 and 2.

In the embodiment, a coupler terminal unit C' according to the present invention includes a rectangular housing portion C2', and there is no member corresponding to the flat plate portion C1 in the conventional unit C. The housing portion C2' includes an upstanding wall 4' and a bottom wall 4'*a*, and input terminals 4'A are implanted on the bottom wall 4'*a*. Further, each of the input terminals 4'A is contiguous with each of terminal pieces 6'. That is, a plate member is bent into L shape, and an upstanding portion of the plate member is implanted on the bottom wall 4'*a* and functions as the input terminal 4'A, whereas remaining portion of the plate member functions as the terminal piece 6' directed in a direction the same as the longitudinal direction of the housing portion 4'. The terminal pieces 6' are formed with an upstanding cut piece 6'X and a notch 6'Y for connecting Litz wires (not shown). As a result, the terminal pieces extend in the longitudinal direction of the housing portion C2' which direction is perpendicular to the extending direction of the attachment piece 3'.

Further, an eyelet 5 is positioned within the housing portion C2', so that the coupler terminal unit C' is fixedly coupled to a tongue piece or attachment piece 3' of a speaker frame 2. As shown, the eylet 5 is provided at a central portion of the bottom wall 4'*a* and between the input terminals 4'A.

With this structure, a projecting length L' of the tongue piece 3' can be reduced, since the tongue piece is directly connected to the housing portion C2'. In other words, the housing portion C2′ can be positioned much closer to the speaker frame 2 in comparison with the conventional arrangement.

In view of the foregoing, according to the present invention, the coupler terminal unit can be positioned close to the outer periperal edge portion of the speaker frame in the radial direction thereof. Therefore, mechanical abutment or inteference between the coupler terminal unit and a vehicle component can be minimized when the speaker unit is intended to be installed on a limitted space of a vehicle compartment. Further, the eyelet fixing work can be achieved easily, since the eyelet fixing work is not carried out at the blind portion (at the flat plate portion C1 behind the bulk of housing portion C2), but can be carried out at an open area (on the housing portion C2′).

While the invention has been described in detail and with reference to specific embodiment thereof, it would be apparent for those skilled in the art that various changes and modifications can be made therein without departing from the spirit and scope of the invention.

What is claimed is :

1. A speaker unit having a coupler terminal unit, the speaker unit comprising:

a speaker frame; and an attachment piece extending radially outwardly from said speaker frame;

and said coupler terminal unit comprising:

a housing portion having four perpendicular upstanding side walls and a bottom wall for defining an internal space;

an eyelet member positioned at the internal space for fixedly connecting the housing portion to the attachment piece; and a pair of terminal pieces, situated such that one terminal piece extends outward from a sidewall of the housing portion which sidewall is parallel to the extending direction of said attachment piece, and the other terminal piece extends outward from another sidewall of the housing portion which sidewall is also parallel to the extending direction of said attachment piece.

2. A speaker unit having a coupler terminal unit as claimed in claim 1, wherein the eyelet member extends through the bottom wall of the housing portion and is positioned at a central portion thereof.

3. A speaker unit having a coupler terminal unit as claimed in claim 1, further comprising input terminals implanted on the bottom wall, the eyelet being positioned between the input terminals, and wherein each of the input terminals is provided integral with each of the terminal pieces.

4. A speaker unit having a coupler terminal unit as claimed in claim 1, wherein the housing portion has a rectangular cross-section providing its longitudinal direction and wherein the terminal pieces extend in the longitudinal direction of the housing portion which direction is perpendicular to the extending direction of the attachment piece.

* * * * *